United States Patent [19]

Wolf

[11] 4,331,849

[45] May 25, 1982

[54] LEVER CONTROL FOR REALISTIC DRIVING TOY

[76] Inventor: Tobin Wolf, 285 Aycrigg Ave., Passaic, N.J. 07055

[21] Appl. No.: 140,869

[22] Filed: Apr. 16, 1980

[51] Int. Cl.[3] ..... H01H 25/04

[52] U.S. Cl. ..... 200/61.85; 46/249; 46/251; 200/6 A; 200/16 C; 200/252

[58] Field of Search ..... 200/6 A, 6 R, 6 B, 6 BA, 200/6 BB, 6 C, 1 V, 16 R, 11 G, 61.85, 157, 163, 164 R, 164 A, 252, 4; 46/248, 249, 251, 253

[56] References Cited

U.S. PATENT DOCUMENTS

| | | | |
|---|---|---|---|
| 3,030,459 | 4/1972 | Elliott et al. | 200/6 A |
| 3,643,294 | 2/1972 | Wilson | 200/6 A |
| 4,041,258 | 8/1977 | Harada | 200/6 A |

FOREIGN PATENT DOCUMENTS

| | | | |
|---|---|---|---|
| 1462860 | 1/1977 | United Kingdom | 46/23 |

*Primary Examiner*—J. V. Truhe
*Assistant Examiner*—Morris Ginsburg
*Attorney, Agent, or Firm*—Jay M. Cantor

[57] ABSTRACT

A control lever for a toy wherein the lever has two degrees of freedom and includes a stem portion loosely engaging a hole centrally located in an electrically non-conductive switch plate. The square switch plate has four rectangular electrically conductive areas positioned adjacent the sides thereof. The switch plate is held against a frame by means of four sets of flexible contacts, each set associated with one of the conductive areas. The switch plate is movable with two degrees of freedom by movement of the lever, whereby none, one or two different adjacent pairs of flexible contacts will be positioned on a rectangular conductive area. In this manner, two motors which control the direction of the vehicle can be selectively off, rotating in a forward direction or rotating in a rearward direction. In accordance with a second embodiment of the invention the switch plate has a square conductive area with a non-conductive interior on both surfaces of the non-conductive switch plate, the flexible contacts being provided in pairs, one positioned above the switch plate and the other positioned below the switch plate.

11 Claims, 6 Drawing Figures

LEVER CONTROL FOR REALISTIC DRIVING TOY

BACKGROUND OF THE INVENTION

This invention relates to a lever control for steering a realistic driving toy.

DESCRIPTION OF THE PRIOR ART

Driving toys of the prior art have been controlled by a multitude of different types of control devices, these being in the form of steering wheels as well as levers. It is often desirable that the lever control be used to simulate the real vehicle being controlled such as in the case of a construction vehicle, a space ship or the like. In toy vehicles of this type, steering is normally provided by use of a pair of motors, one motor controlling each of a pair of adjacent wheels whereby when both motors rotate in the same direction, the vehicle will move forward or rearward whereas when only one of the two motors rotates or both motors rotate in opposite directions, the vehicle will turn, the direction of turning being dependent upon the direction of rotation of the motors. Such types of control have been known in the prior art but have been relatively expensive to produce or, alternatively, when inexpensive, have been clumsy and have displayed very low life span.

SUMMARY OF THE INVENTION

In accordance with the present invention, there is provided a lever control for a realistic driving toy wherein the control mechanism is relatively inexpensive though totally realistic and has a substantial life expectancy relative to prior art systems of equal cost. Briefly, there is provided a control lever for a toy wherein the lever has two degrees of freedom and includes a stem portion loosely engaging a hole centrally located in an electrically non-conductive switch plate. The square switch plate has four rectangular electrically conductive areas positioned adjacent the sides thereof. The switch plate is held against a frame by means of four sets of flexible contacts, each set associated with one of the conductive areas. The switch plate is movable with two degrees of freedom by movement of the lever whereby none, one or two different adjacent pairs of flexible contacts will be positioned on a rectangular conductive area. In this manner, two motors which control the direction of the vehicle can be selectively off, rotating in a forward direction or rotating in a rearward direction. In accordance with a second embodiment of the invention, the switch plate will have a square conductive area with a non-conductive interior on both surfaces of the non-conductive switch plate, the flexible contacts being provided in pairs, one positioned above the switch plate and the other positioned below the switch plate.

DESCRIPTION OF THE PREFERRED EMBODIMENTS

Figure 1:
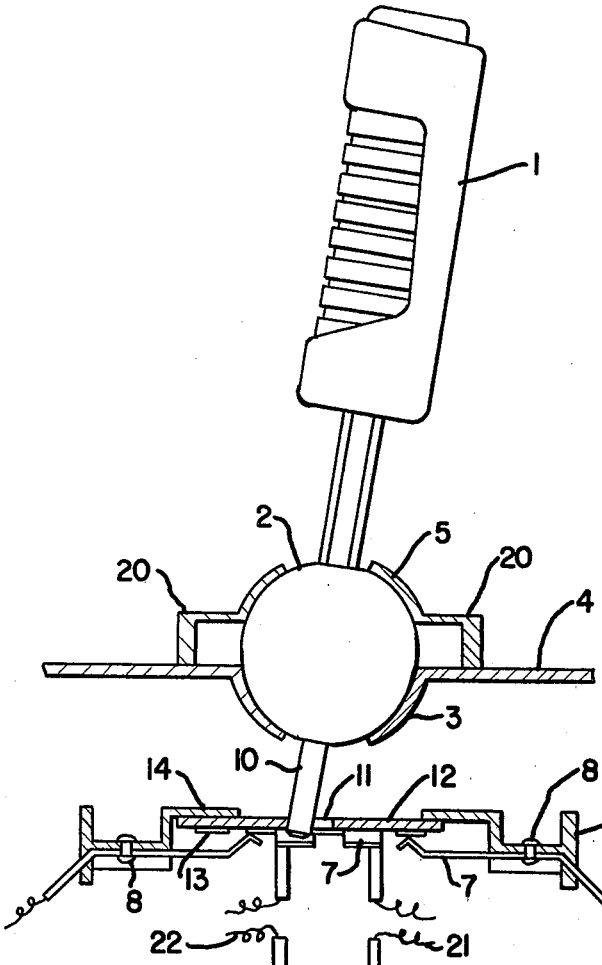
FIG. 1 is a vertical cross-section view through the center of the lever control for a realistic driving toy in accordance with the present invention.
Figure 2:
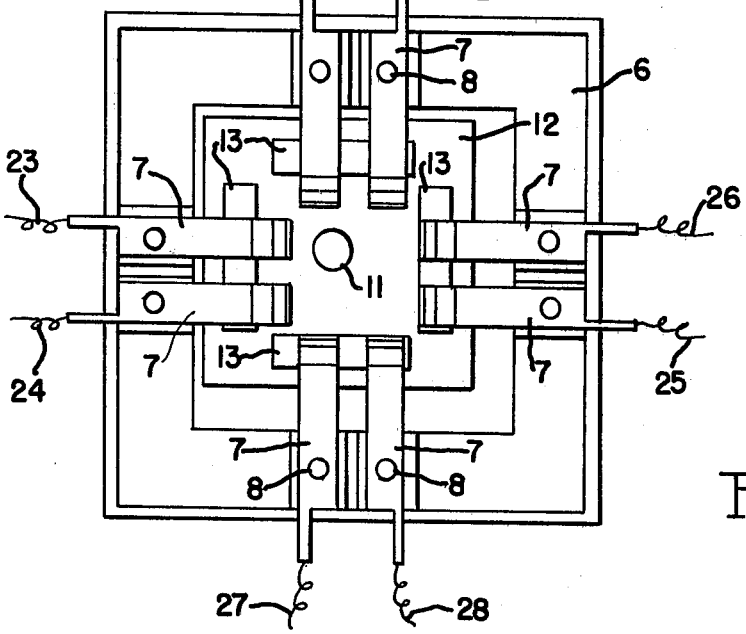
FIG. 2 is a bottom view of the lever control of FIG. 1.

Referring now to FIG. 1, there is shown a first embodiment of a lever control for a realistic driving toy in accordance with the present invention. The control includes a hand grip which is secured to a ball joint 2 confined within a ball socket, the ball socket being constructed from a hemispherical depression in the base 4 of a housing and a hemispherical cap 5. The cap 5 is secured to the housing 4 by means of conventional fasteners through the annular ring 20. Mounted to the under side of the base 4 on mounting bosses (not shown) is a square frame 6 to which eight flexible electrical contacts 7 are affixed by conventional fasteners 8. This is best shown in FIG. 2.

Projecting axially downward from the ball joint 2 and affixed thereto is a stem 10 loosely engaging an aperture 11 which is centrally located in a non-electrically conductive switch-plate 12 having on its bottom surface four rectangular electrically conductive areas 13. The electrically conductive areas may be metal plates cemented to the switch plate 12 or otherwise affixed to plate 12 or may be achieved by etching as in printed-circuit techniques.

The switch plate 12 is in slidable contact with the eight flexible contacts 7, said contacts being upwardly biased and always touching either the non-conductive surface of plate 12 or one or two of the conductive areas 13, depending upon the position of the switch plate 12 at any given time. The lip 14 on the frame 6 maintains the position of the switch plate 12 against the upwardly biased contacts.

Rotation of the ball 2 by movement of the lever 1 will cause the stem 10 to move with essentially two degrees of freedom in a plane, the plane of the switch plate 12, thereby selectively causing the flexible contacts 7 to be positioned over the rectangular conductive areas 13. It is apparent that opposite pairs of flexible contacts can not simultaneously be in contact with a conductive area 13. However, adjacent contact pairs can simultaneously be in contact with an associated conductive area. It is also possible that none of the contacts 7 be in contact with a conductive area 13 at a given time. This will happen when the lever 1 is in the vertical position. It can therefore be seen that, by judicious operation of the lever 1, it is possible to have either none of the contact elements in contact with a conductive area or have any one pair of the contact elements in contact with one conductive area or have any pair of adjacent contact pairs in contact with associated conductive regions 13.

Figure 3:
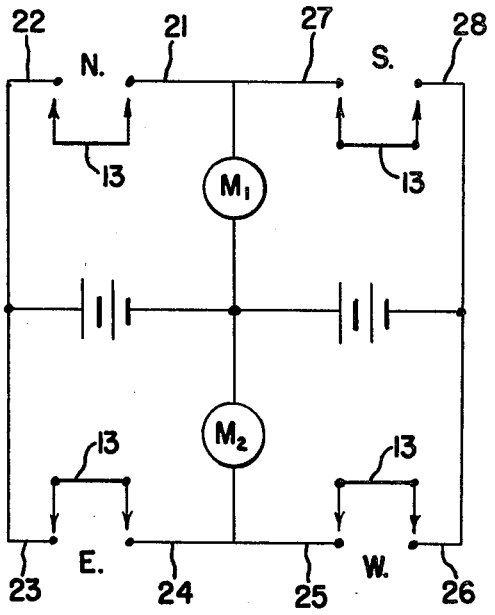
FIG. 3 is an electrical circuit diagram of the embodiment of FIGS. 1 and 2 with the addition of the controlled motors and power source.

Referring now to FIGS. 2 and 3 it can be seen that the leads 21 and 22 are associated with a northerly direction of the vehicle whereas leads 23 and 24 are associated with an easterly direction of the vehicle, leads 25 an 26 are associated with a westerly direction of the vehicle and leads 27 and 28 are associated with a southerly direction of the vehicle, these directions being arbitrary. Therefore, if only leads 21 and 22 are actuated, the motor M1 only will operate to move the vehicle in a northerly direction. If the leads 27 and 28 are actuated, then the motor M1 will move the vehicle in a southerly direction due to a reveral of the direction of rotation of M1. Similarly, actuation of leads 23 and 24 will move the vehicle in an easterly direction via motor M2 and actuation of leads 25 and 26 will move the vehicle in a westerly direction via motor M2. It is also apparent that the vehicle can be moved at an angle 45° with respect to north, south, east or west by operation of both motors M1 and M2 simultaneously. As can be seen from FIGS. 2 and 3, this is accomplished by having an adjacent pair of contact pairs in contact with the conductive areas 13 associated therewith to actuate the associated leads.

Figure 4:
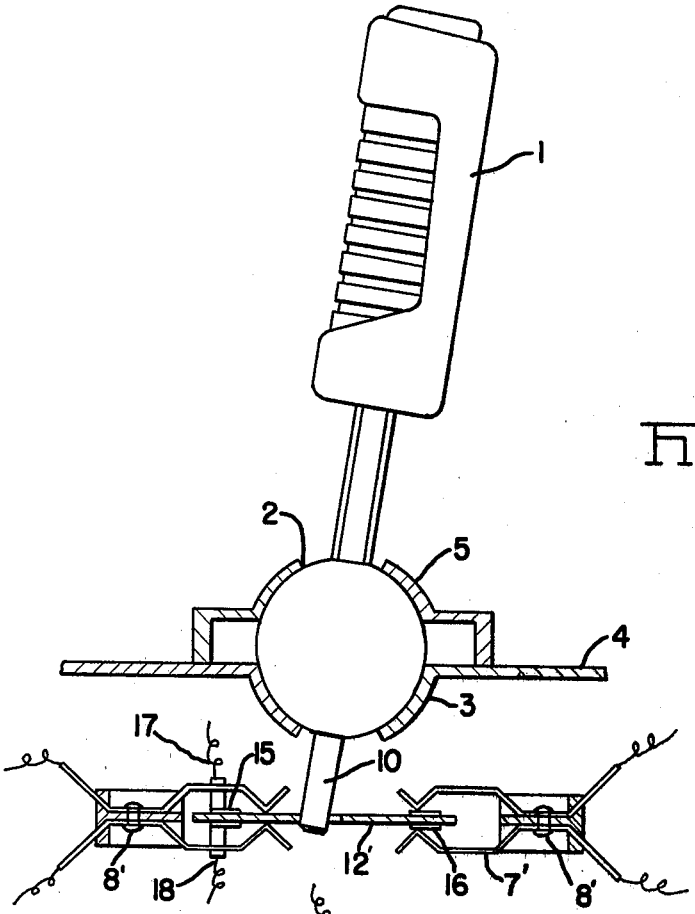
FIG. 4 is a vertical cross-section view of a second embodiment of the invention.
Figure 5:
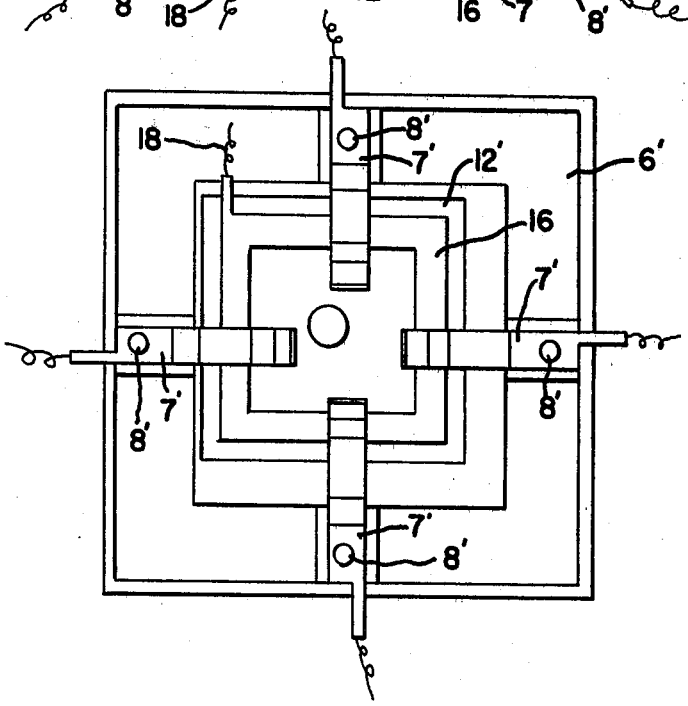
FIG. 5 is a bottom view of the embodiment of FIG. 4.

Referring now to FIGS. 4 and 5, there is shown a second embodiment of the invention. In this embodiment, all of the elements are the same as in the first embodiment except the switch plate 12' includes continuous conductive patterns 15 and 16 on the upper and lower surface of the switch plate. The flexible contacts 7' are positioned, one above the plate 12' to contact an associated conductive area 15, and one below the plate for contact with the conduction area 16. An associated flexible contact pair 7' is fastened to the plate or frame 6' by means of an insulator or a non-conductive fastener 8'. The slidable contacts are fixed on opposite surfaces of the plate 12'.

As shown in the circuit diagram (FIG. 6), the upper conductive area 15 always has a negative potential while the conductive area 16 always has a positive potential. The polarity of the motor terminals is determined by the wiring to the contact pairs 7'.

Figure 6:
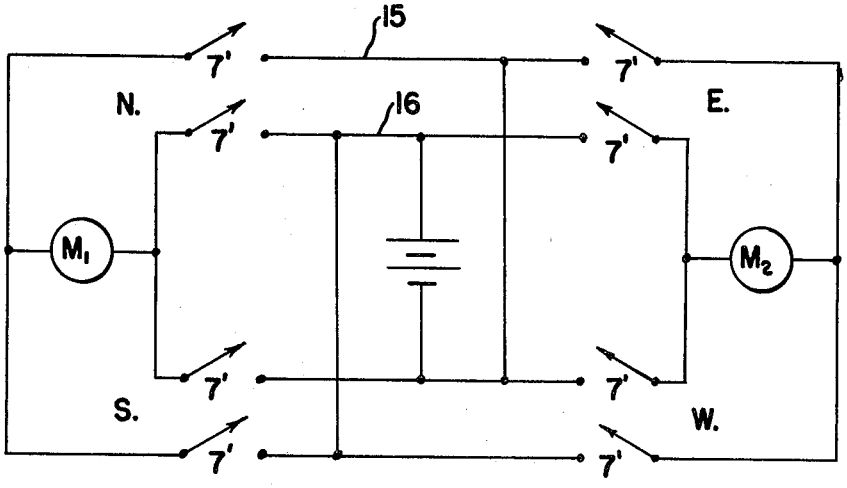
FIG. 6 is an electrical circuit diagram of the embodiment of FIGS. 4 and 5 with the addition of the two controlled motors and the power source.

Thus, in FIG. 6, it can be seen that if the north contact pair touches the areas 15 and 16, the motor will turn in one direction and if the south contact pair touches the areas 15 and 16, the polarity and direction is reversed.

The advantage of this system is that only one set of cells is required.

According to the embodiment of FIGS. 1 to 3, the operator will grasp the lever 1 and move same anywhere in an arcuate plane, thereby causing ball joint 2 to rotate and move pin 10, thereby causing switch-plate 12 to move along with pin 10. By judicious movement of the lever 1, the contacts 7 can contact no conductive areas 13, as when the lever 1 is vertical, or can contact one conductive area 13 as when the lever is moved in a north, south, east or west direction (up, down, left or right) or can contact two conductive areas as when the lever is moved in the direction of any corner of the frame 6 as shown in FIG. 2.

According to the embodiment of FIGS. 4 to 6, the lever 1 will be operated in the same manner as for the embodiment of FIGS. 1 to 3. As can be seen from FIG. 6, in the north and south positions, motor M1 only will operate in forward or reverse directions. Similarly, in the east and west positions, motor M2 only will operate in the forward or reverse directions. Two motors, M1 and M2, can be operated simultaneously by moving the lever 1 to a corner of the square.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A control system for a toy vehicle comprising:

(a) a frame, (b) a plate positioned adjacent said frame and universally movable in a plane parallel to the plane of said frame, (c) control means contacting said plate for moving said plate in said plane, (d) plural electrically conductive areas disposed on said plate, and (e) electrical contact means associated with each of said electrically conductive areas, whereby said contact means selectively contact said associated conductive areas responsive to the position of said plate in said plane, wherein one surface of said plate contacts said frame and wherein said electrical contact means are resilient and are biased against said plate on the side of said plate opposite said one surface to maintain said plate in contact with said frame.

2. A control system as set forth in claim 1 wherein said plate is electrically non-conductive.

3. A control system as set forth in claim 2, wherein said plate is rectangular and said electrically conductive areas are respectively alongside each side of said rectangle.

4. A control system as set forth in claim 2 wherein said plate includes means engageable by said control means and said control means includes engaging means for engaging said means engageable by said control means.

5. A control system as set forth in claim 4 wherein said means engageable is an aperture in said plate and said engaging means is a pin secured to spherical means and engaging said aperture whereby movement of said pin in said aperture moves said plate in said plane.

6. A control system as set forth in claim 4 wherein said plate is square and said electrically conductive areas are respectively disposed alongside each side of said square.

7. A control system as set forth in claim 1 wherein said plate includes means engageable by said control means and said control means includes engaging means for engaging said means engageable by said control means.

8. A control system as set forth in claim 7 including spherical means mounted for universal movement, said means engageable in an aperture in said plate and said engaging means is a pin secured to said spherical means and engaging the wall of said aperture whereby movement of said pin in said aperture moves said plate in said plane.

9. A control system as set forth in claim 8 wherein said plate is rectangular and said electrically conductive areas are respectively disposed alongside each side of said rectangle.

10. A control system as set forth in claim 7 wherein said plate is rectangular and said electrically conductive areas are respectively disposed alongside each side of said rectangle.

11. A control system as set forth in claim 1 wherein said plate is rectangular and said electrically conductive areas are respectively disposed alongside each side of said rectangle.

* * * * *